US008733882B2

(12) United States Patent
Yudasaka et al.

(10) Patent No.: US 8,733,882 B2
(45) Date of Patent: May 27, 2014

(54) PRINTER CONTROL METHOD AND PRINTER

(75) Inventors: Shingo Yudasaka, Matsumoto (JP); Toshiyuki Sugimoto, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 260 days.

(21) Appl. No.: 13/419,370

(22) Filed: Mar. 13, 2012

(65) Prior Publication Data

US 2012/0236061 A1 Sep. 20, 2012

(30) Foreign Application Priority Data

Mar. 15, 2011 (JP) ..... 2011-056660

(51) Int. Cl.
*B41J 29/393* (2006.01)

(52) U.S. Cl.
USPC ..... 347/19; 347/23

(58) Field of Classification Search
USPC ..... 347/19, 23
See application file for complete search history.

(56) References Cited

U.S. PATENT DOCUMENTS

| | | | | |
|---|---|---|---|---|
| 6,565,185 | B1 * | 5/2003 | Endo | 347/23 |
| 8,123,331 | B2 * | 2/2012 | Shindo et al. | 347/23 |
| 8,147,027 | B2 * | 4/2012 | Hara | 347/23 |
| 8,177,315 | B2 * | 5/2012 | Endo et al. | 347/14 |
| 8,382,241 | B2 * | 2/2013 | Saitoh et al. | 347/35 |
| 2007/0229641 | A1 | 10/2007 | Nakazawa | |
| 2012/0113188 | A1 * | 5/2012 | Ishii | 347/34 |

FOREIGN PATENT DOCUMENTS

| | | |
|---|---|---|
| JP | 2007-144785 A | 6/2007 |
| JP | 2007-268749 A | 10/2007 |

* cited by examiner

*Primary Examiner* — Julian Huffman
(74) *Attorney, Agent, or Firm* — Kilpatrick Townsend & Stockton LLP

(57) ABSTRACT

A method of controlling a printer 1 that cuts recording paper according to a paper cut command after printing print data received from a host computer 80 on the recording paper 10. If the paper cut command is received while performing an automatic clogged nozzle detection process on the inkjet head 17 after printing ends (S1: Yes), the automatic clogged nozzle detection process is interrupted (S2), and the cutting process is performed (S3).

8 Claims, 9 Drawing Sheets

PRINTER CONTROL METHOD AND PRINTER

This application claims priority to Japanese Patent Application No. 2011-056660, filed Mar. 15, 2011, the entirety of which is incorporated by reference herein.

BACKGROUND

1. Technical Field

The present invention relates to a printer that has a function for cutting discharged paper, and to a method of controlling the printer.

2. Related Art

Inkjet printers that print by ejecting ink droplets onto recording paper from a paper roll may also have a mechanism for cutting the discharged roll paper. See, for example, Japanese Unexamined Patent Appl. Pub. JP-A-2007-144785 and Japanese Unexamined Patent Appl. Pub. JP-A-2007-268749.

Some inkjet printers are capable of inspecting the ejection state of ink from the ink nozzles, and performing a nozzle cleaning process to eliminate clogged ink nozzles as required based on the result of the inspection. If a command for cutting the roll paper is received during the nozzle checking process that inspects the ink ejection state, the roll paper will be cut after the nozzle check ends. As a result, cutting the paper must wait several seconds after the roll paper cut command is issued until the roll paper is actually cut. Throughput can therefore not be increased, and a drop in work efficiency results.

SUMMARY

A printer control method and a printer according to the invention are capable of printing efficiently and improving work efficiency while also providing good print quality.

One aspect of the invention is a method of controlling a printer that cuts paper according to a paper cut command after printing print data received from a host computer on the paper, including a step of: interrupting an automatic clogged nozzle detection process that automatically detects clogged nozzles in the printhead after printing ends, and then executing a cutting process that cuts the paper, if the paper cut command is received while executing the automatic clogged nozzle detection process.

Because this control method interrupts the automatic clogged nozzle detection process and preferentially executes the cutting process when a paper cut command is received while performing the automatic clogged nozzle detection process, the waiting time until the cutting process executes can be substantially eliminated and throughput can be improved.

As a result, printing can be executed efficiently and job efficiency can be greatly improved. In addition, because the automatic clogged nozzle detection process continues if a paper cut command is not received, problems such as clogged nozzles can be reduced and printing with good print quality is possible.

In a method of controlling a printer according to another aspect of the invention, the automatic clogged nozzle detection process is preferably performed when a print request from the host computer is not received after waiting a specific print request wait time after printing ends.

Because this control method executes the automatic clogged nozzle detection process if a print request is not received by the time the print request wait time passes, that is, while printing is not in progress, printing process throughput is not affected even if the automatic clogged nozzle detection process is interrupted and the cutting process is performed. Overall throughput can thus be improved by preferentially executing the requested cutting process when a print request has not been received.

In a method of controlling a printer according to another aspect of the invention, the cutting process is preferably performed after performing a printhead capping process after interrupting the automatic clogged nozzle detection process.

This control method caps the printhead before the cutting process to protect the printhead, and can thereby maintain the ink meniscus in the nozzles.

With a method of controlling a printer according to another aspect of the invention, the automatic clogged nozzle detection process is preferably performed again after interrupting the automatic clogged nozzle detection process and performing the cutting process.

After performing the cutting process, this control method enables performing the automatic clogged nozzle detection process again and entering the standby mode so that printing with good print quality is always possible.

Another aspect of the invention is a printer that cuts paper according to a paper cut command after printing print data received from a host computer on the paper, including: a nozzle check unit that applies an automatic clogged nozzle detection process to a printhead after printing ends; a paper cutter unit that cuts the paper according to a paper cut command; a cutting operation unit that commands the paper cutter unit to cut the paper when operated by a user; and a control unit that interrupts the automatic clogged nozzle detection process and executes the cutting process when a paper cut command is received while applying the automatic clogged nozzle detection process to the printhead nozzles after printing ends.

The printer thus comprised interrupts the automatic clogged nozzle detection process and preferentially executes the cutting process when a paper cut command is received while performing the automatic clogged nozzle detection process. Throughput can be improved by thus substantially eliminating the waiting time until the cutting process executes.

As a result, printing can be executed efficiently and job efficiency can be greatly improved. In addition, because the automatic clogged nozzle detection process continues if the cutting operation unit is not operated, problems such as clogged nozzles can be reduced and printing with good print quality is possible.

A printer according to another aspect of the invention, the nozzle check unit preferably performs the automatic clogged nozzle detection process when a print request from the host computer is not received after waiting a specific print request wait time after printing ends.

The printer according to this aspect of the invention can improve overall throughput by preferentially executing the requested cutting process when a print request has not been received.

A printer according to another aspect of the invention preferably also has a capping unit that caps the nozzle surface of the printhead with a head cap. The control unit causes the capping unit to perform a capping process that covers the nozzle surface of the printhead with a head cap after causing the nozzle check unit to interrupt the automatic clogged nozzle detection process, and then causes the paper cutter unit to perform the cutting process.

This printer caps the printhead before the cutting process to protect the printhead, and can thereby maintain the ink meniscus in the nozzles.

In a printer according to another aspect of the invention, the control unit preferably causes the nozzle check unit to interrupt the automatic clogged nozzle detection process, causes the paper cutter unit to perform the cutting process, and then causes the nozzle check unit to perform the automatic clogged nozzle detection process again.

After performing the cutting process, this printer can perform the automatic clogged nozzle detection process again and then enter the standby mode so that printing with good print quality is always possible.

Other objects and attainments together with a fuller understanding of the invention will become apparent and appreciated by referring to the following description and claims taken in conjunction with the accompanying drawings.

DESCRIPTION OF EMBODIMENTS

A preferred embodiment of a printer control method and printer driver according to the present invention is described below with reference to the accompanying figures.

Figure 1:
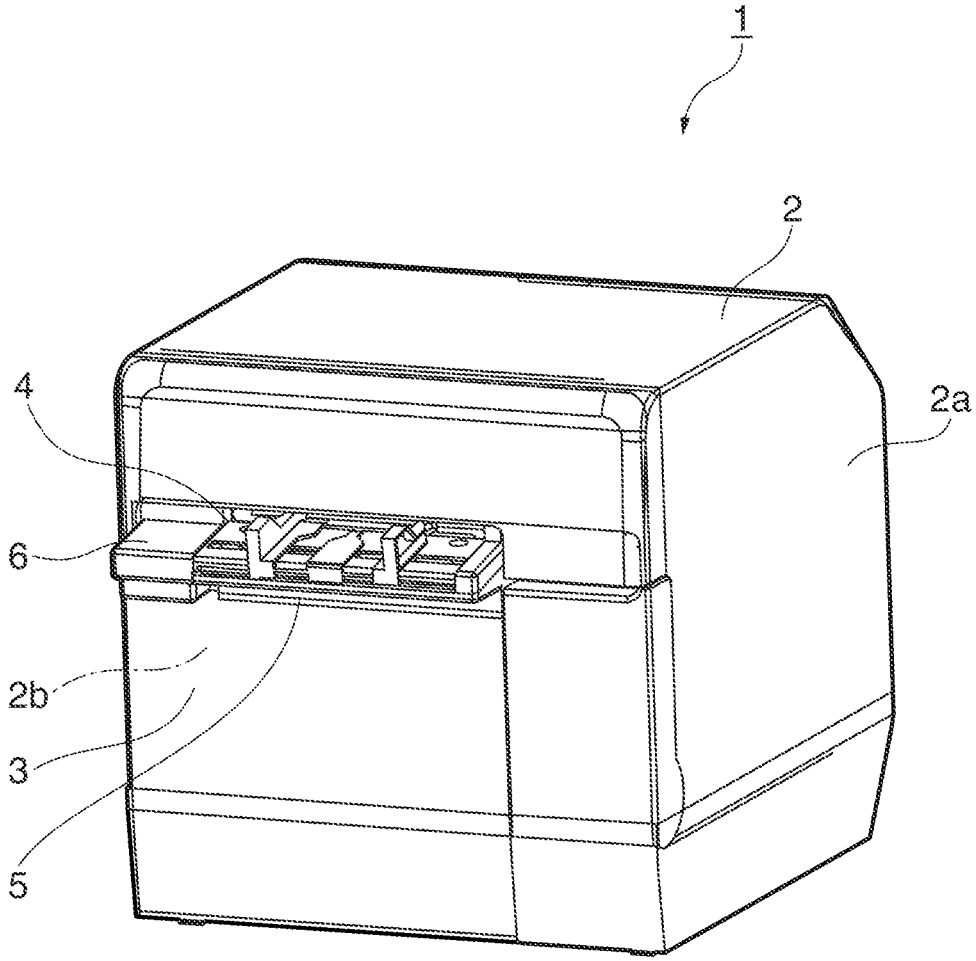
FIG. 1 is an external oblique view showing a preferred embodiment of a printer using the printer control method according to the invention.
Figure 2:
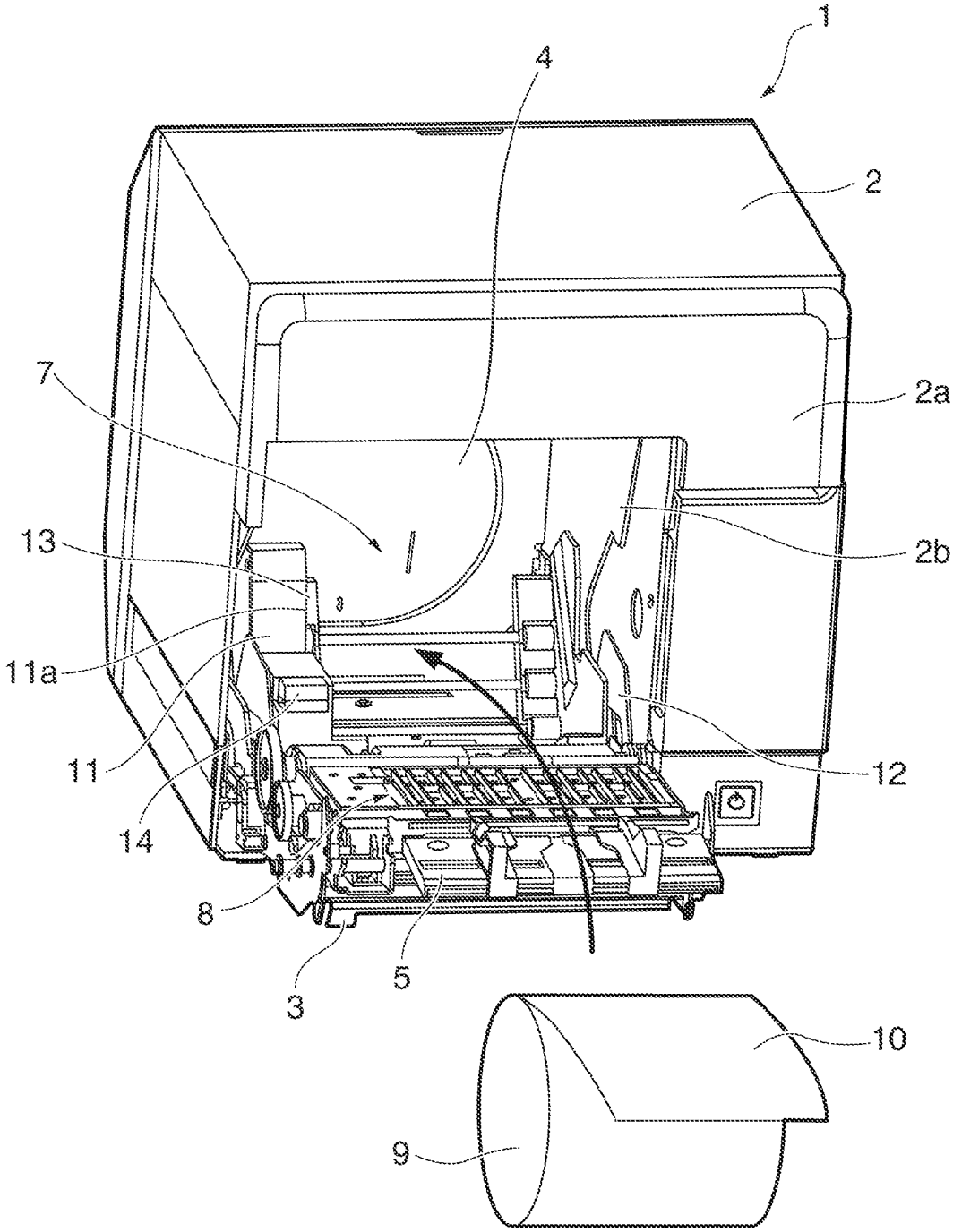
FIG. 2 is an external oblique view of the printer in FIG. 1 with the cover open.

As shown in FIG. 1 and FIG. 2, the printer 1 according to this embodiment of the invention is a roll paper printer that prints to roll paper 9 as the recording paper. The printer 1 has a generally rectangular, box-shaped printer housing 2, and an access cover 3 attached to the front of the printer housing 2. A paper exit 4 of a specific width is formed in the front of the outside case 2*a* of the printer housing 2. A discharge guide 5 protrudes to the front below this paper exit 4, and a cover lock lever 6 is disposed beside the discharge guide 5. A rectangular opening 2*b* (see FIG. 2) for loading and unloading roll paper is formed in the outside case 2*a* below the discharge guide 5 and cover lock lever 6, and this opening 2*b* is closed by the access cover 3.

Operating the cover lock lever 6 unlocks the access cover 3. When the discharge guide 5 is then pulled forward, the access cover 3 opens to a substantially horizontal position pivoting on the bottom end thereof as shown in FIG. 2. When the access cover 3 opens, the roll paper compartment 7 formed inside the printer housing 2 is open. The vacuum platen (platen) 8 that defines the printing position moves with the access cover 3, the recording paper conveyance path from the roll paper compartment 7 to the paper exit 4 opens, and the roll paper 9 can be replaced from the front of the printer housing 2.

The roll paper 9 is stored in the roll paper compartment 7 with the axis running widthwise to the printer. The roll paper compartment 7 has a first wall 11 and a second wall 12 on the left and right sides that determine the storage width, and the first wall 11 and second wall 12 can slide widthwise to the printer to accommodate roll paper 9 of different widths. A lock mechanism that prevents the first wall 11 from moving widthwise to the printer, and a roll paper urging member 13 are disposed to the first wall 11, and the operating part 14 of this lock mechanism protrudes from the front top part of the first wall 11. The distal end of the roll paper urging member 13 protrudes into the roll paper compartment 7 from an opening formed in the inside surface 11*a* of the first wall 11. The roll paper urging member 13 is configured to move between the protruding position shown in FIG. 2 and a retracted position where the end face of the distal end is flush with the inside surface 11*a* of the first wall 11, and is constantly urged to the protruding position by a specific elastic force.

When the operating part 14 is manually depressed, the first wall 11 is unlocked and the first wall 11 can be moved widthwise to the printer and positioned to the paper width of the roll paper 9 to be loaded. When the operating part 14 is then released, the lock engages again to prevent movement of the first wall 11. When the roll paper 9 is loaded after adjusting the first wall 11 to the paper width, the roll paper urging member 13 pushes the roll paper 9 to the second wall 12 side, thus preventing the loaded roll paper 9 from moving sideways. Note that the cover case 3*a* of the access cover 3 and the cover lock lever 6 are not shown in FIG. 2.

Figure 3:
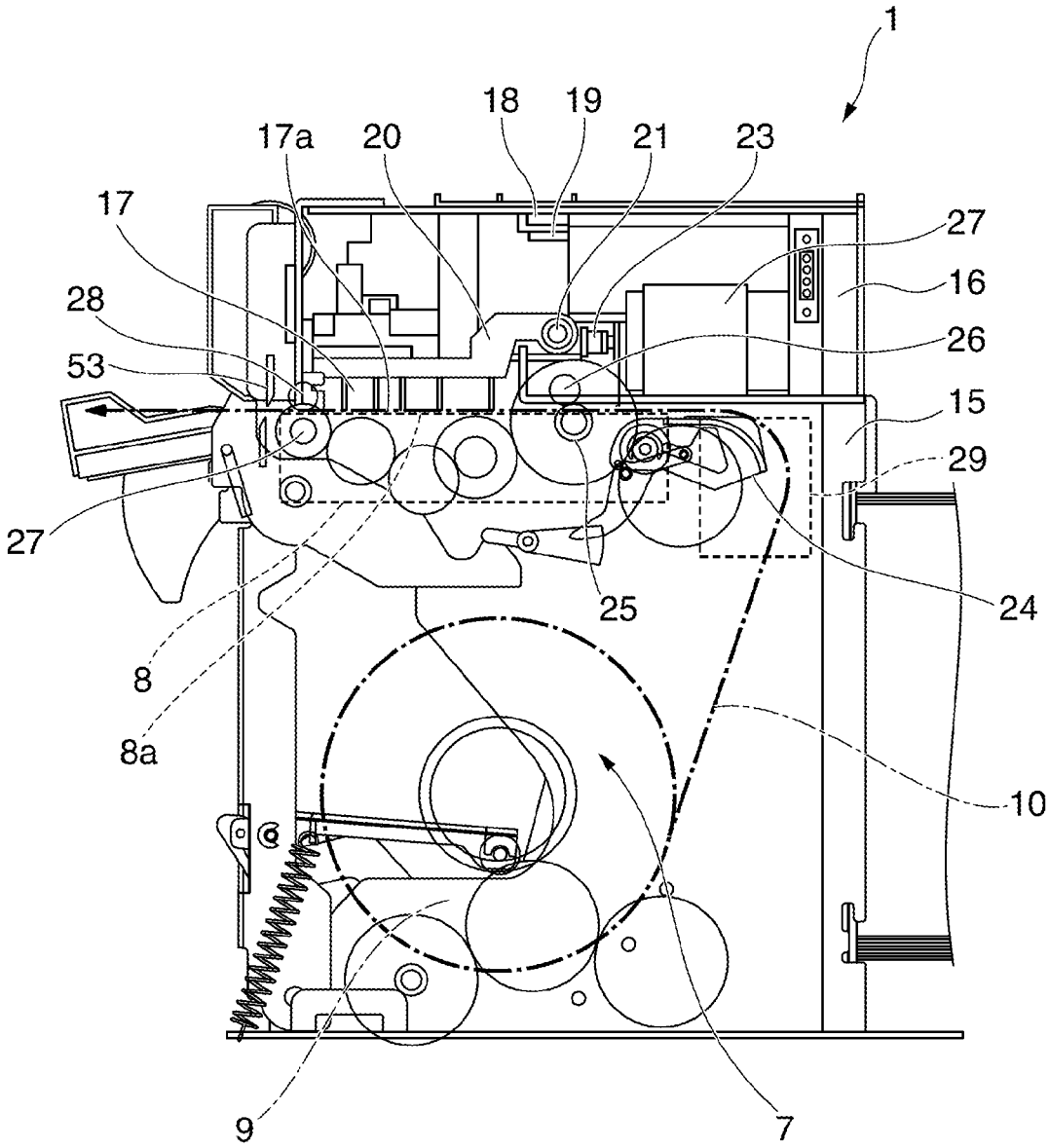
FIG. 3 is a section view of the printer in FIG. 1.

As shown in FIG. 3, the roll paper compartment 7 is formed in the middle of the width of the main printer frame 15 inside the printer 1. A head unit frame 16 is attached horizontally to the top of the main printer frame 15 above the roll paper compartment 7. Disposed to the head unit frame 16 are an inkjet head 17, a linear scale 18 and encoder sensor 19 for detecting the position of the inkjet head 17, a carriage 20 that carries the inkjet head 17 and encoder sensor 19, and a carriage guide shaft 21 that guides movement of the carriage 20 widthwise to the printer.

The inkjet head 17 is mounted on the carriage 20 with the nozzle face 17*a* facing down. The carriage guide shaft 21 extends horizontally widthwise to the printer. Also disposed to the head unit frame 16 is a carriage conveyance mechanism including a carriage motor 22 and timing belt 23 for moving the carriage 20 reciprocally along the carriage guide shaft 21.

The vacuum platen 8 is disposed horizontally widthwise to the printer below the inkjet head 17 with a specific gap therebetween. The vacuum platen 8 pulls the back side of the printed surface of the recording paper 10 to the platen surface 8*a* as the recording paper (paper) 10 delivered from the paper roll 9 passes the printing position. A recording paper suction mechanism is configured in the vacuum platen 8 and printer housing 2.

A tension guide 24 that curves down is disposed to the back end of the vacuum platen 8, and the tension guide 24 is urged upward by the force of a spring. The recording paper 10 pulled from the roll paper 9 stored in the roll paper compartment 7 is pulled through the recording paper conveyance path that passes the printing position with specific tension applied to the paper by the tension guide 24.

A rear paper feed roller 25 is disposed horizontally widthwise to the printer behind the vacuum platen 8. A rear pressure roller 26 of a specific width is pressed with a specific pressure to the rear paper feed roller 25 with the recording paper 10 therebetween. A front paper feed roller 27 is disposed to a position in front of the vacuum platen 8, and a front pressure roller 28 is pressed from above to the front paper feed roller 27 with the recording paper 10 therebetween. The rear paper feed roller 25 and the front paper feed roller 27 are driven by a paper feed motor 29 mounted on the main printer frame 15.

A paper cutter 53 is disposed to the paper exit 4, and the recording paper 10 discharged from the paper exit 4 by the front paper feed roller 27 and front pressure roller 28 is cut by the paper cutter 53. The vacuum platen 8, tension guide 24, rear paper feed roller 25, and front paper feed roller 27 move with the access cover 3 when the access cover 3 opens and closes.

Figure 4:
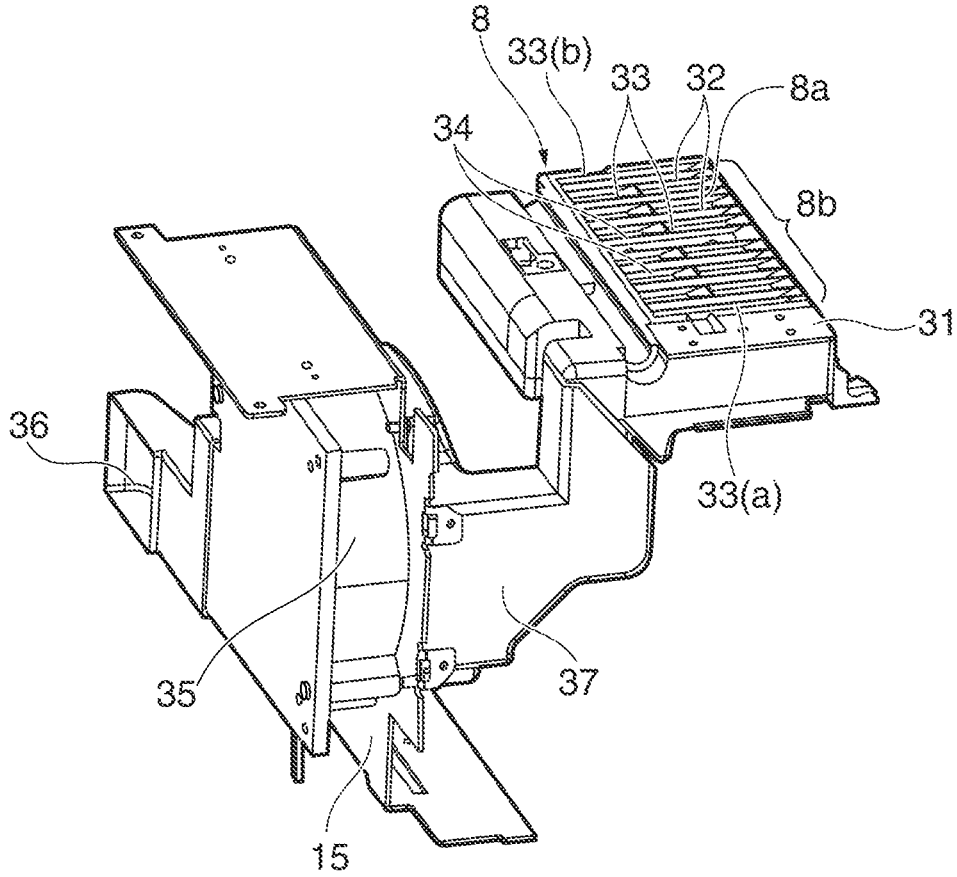
FIG. 4 is a partial oblique view of the vacuum platen and recording paper suction mechanism in the printer shown in FIG. 1.
Figure 5:
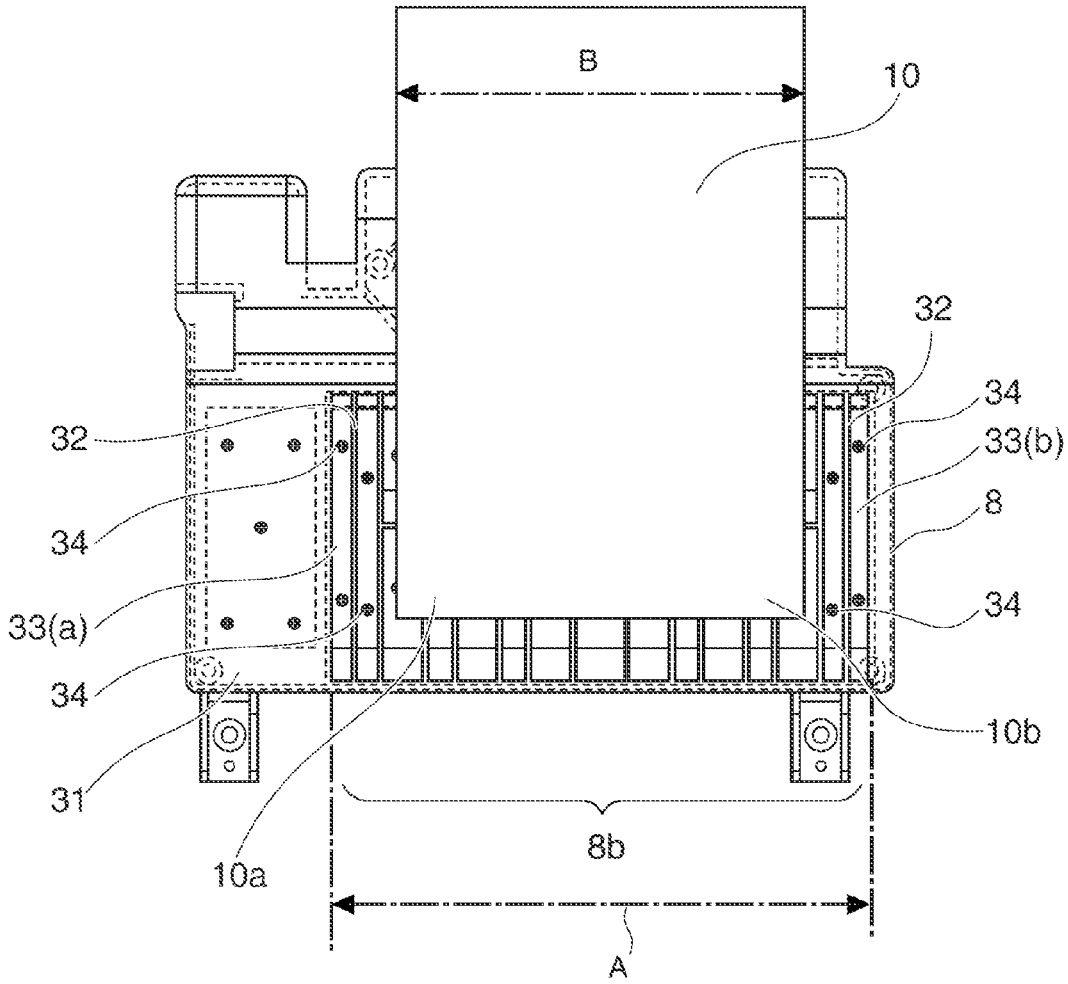
FIG. 5 is a plan view of the vacuum platen when recording paper passes in the printer shown in FIG. 1.

As shown in FIG. 4 and FIG. 5, the vacuum platen 8 is a flat rectangle disposed with the long side aligned with the printer width. An ink mist recovery unit 31 that recovers ink mist produced by ink droplets ejected from the inkjet head 17 is formed at the side of the vacuum platen 8 in unison with the vacuum platen 8. The surface 8*a* of the vacuum platen 8 is divided into a plurality of channel-like chambers 33 by a plurality of longitudinal ribs 32. The recording paper suction mechanism includes these plural chambers 33, suction holes 34 formed in the bottom of the plural chambers 33, a vacuum fan 35 affixed to the back panel of the main printer frame 15, and an air channel 37 that communicates through the suction holes 34 with each of the chambers 33 and communicates through the vacuum fan 35 with an exhaust vent 36 formed in the back of the printer housing 2.

The vacuum platen 8 and air channel 37 can be connected and disconnected from each other. The vacuum platen 8 disconnects from the air channel 37 when the access cover 3 opens because the vacuum platen 8 moves forward with the access cover 3. Because the vacuum platen 8 returns to the original position when the access cover 3 closes, the vacuum platen 8 also reconnects to the air channel 37. When the vacuum platen 8 and air channel 37 are connected and the vacuum fan 35 operates, air is pulled in from the suction holes 34 and the recording paper 10 conveyed over the surface 8*a* of the vacuum platen 8 is pulled to the surface 8*a*.

Note that the width of the vacuum platen 8 is aligned with the width of the printer, and the top openings of the chambers 33 render the suction area 8*b* of the vacuum platen 8. As shown in FIG. 5, the width A of the suction area 8*b* of the vacuum platen 8 is the width from the left end of the top opening of the chamber 33(*a*) at the left end of the vacuum platen 8 to the right end of the top opening of the chamber 33(*b*) at the right end. Paper width B of the recording paper 10 is the width of the recording paper 10 in the direction of the vacuum platen 8 width.

When printing, the printer 1 operates the vacuum fan 35 and pulls the recording paper 10 fed from the roll paper 9 to the suction area 8*b* of the vacuum platen 8. The printer 1 also repeats the operation that moves the inkjet head 17 across to the vacuum platen 8 and prints by moving the carriage 20 along the carriage guide shaft 21, and the operation that conveys the recording paper 10 a specific pitch in the direction perpendicular to the width of the vacuum platen 8 by rotationally driving the rear paper feed roller 25 and front paper feed roller 27.

Part of the suction area 8*b* will be exposed outside the first and second paper edges 10*a*, 10*b* at the opposite sides of the recording paper 10 width B if the paper width B of the recording paper 10 used for printing is narrower than the width A of the vacuum platen 8 suction area 8*b*. As a result, air flow is produced near the first and second paper edges 10*a*, 10*b* by the suction of air through these exposed parts. This air flow disperses paper dust and other particulate above the first and second paper edges 10*a*, 10*b*. Because the edges of the recording paper 10 are the cut paper fibers, paper dust is easily produced. Furthermore, because this embodiment has first and second walls 11 and 12 that hold the roll paper 9 in the roll paper compartment 7 from the sides and prevent sideways movement, the ends of the roll paper 9 rub against the first and second walls 11 and 12 and produce paper dust every time the recording paper 10 is conveyed. This paper dust may be conveyed with the recording paper 10 from the roll paper compartment 7 to the vacuum platen 8.

As a result, when the recording paper 10 width B is narrower than the width A of the vacuum platen 8 suction area 8*b*, the printer 1 controls driving recording paper 10 conveyance so that the recording paper 10 is conveyed when the inkjet head 17 nozzle face 17*a* is at a position separated a specific distance from the first and second paper edges 10*a*, 10*b*. As a result, paper dust and other foreign matter conveyed from the roll paper compartment 7 to the printing position does not disperse and adhere to the nozzle face 17*a*.

Figure 6:
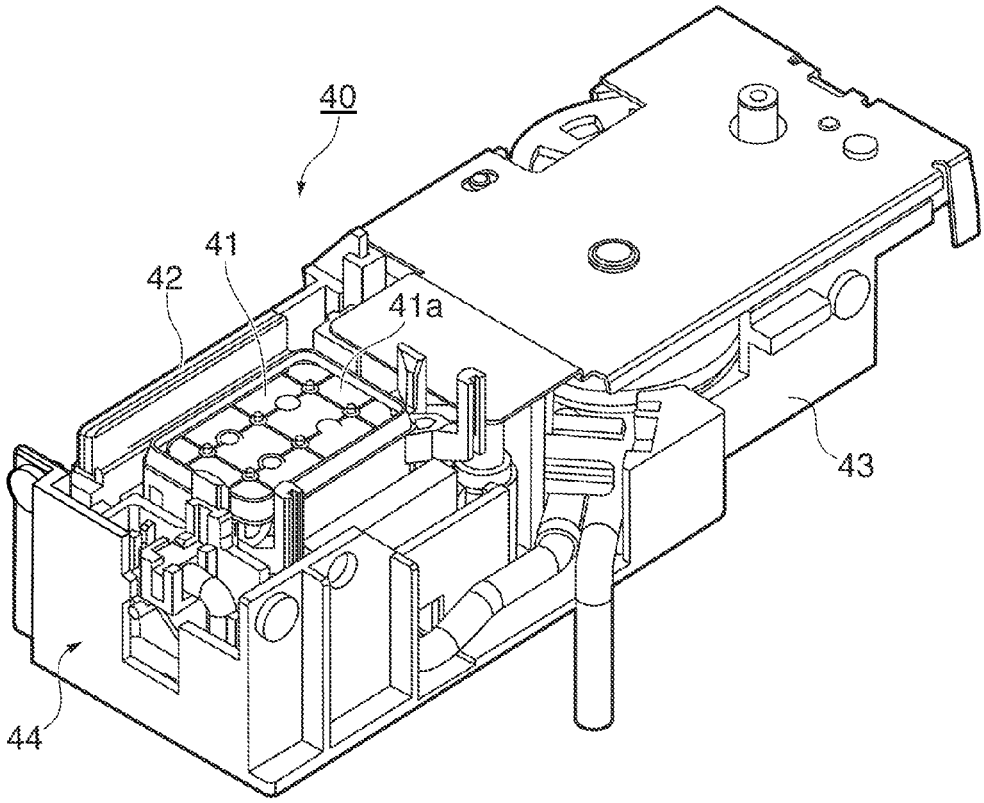
FIG. 6 is an oblique view of the head cleaning mechanism of the printer in FIG. 1.

As shown in FIG. 6, the printer 1 has a head cleaning mechanism 40, and this head cleaning mechanism 40 is disposed below the standby position of the inkjet head 17. The head cleaning mechanism 40 includes a head cap 41 for capping the nozzle face 17*a* of the inkjet head 17, a wiper 42 for wiping ink and foreign matter sticking to the nozzle face 17*a*, and an ink vacuum unit 43 that vacuums ink left in or clogging the nozzles of the inkjet head 17. The head cap 41, wiper 42, and ink vacuum unit 43 are attached to the frame 44 of the head cleaning mechanism 40. The frame 44 is fastened to the main printer frame 15, which also supports the carriage guide shaft 21 and vacuum platen 8.

The head cap 41 is located directly below the nozzle face 17*a* in the standby position, and includes a capping face 41*a* facing up opposite the nozzle face 17*a*. The head cap 41 is configured slidably up and down perpendicularly to the nozzle face 17*a*, that is, perpendicularly to the carriage guide shaft 21, by operating a drive mechanism not shown. As a result, the head cap 41 moves in the direction causing the capping face 41*a* to move toward or away from the nozzle face 17*a*.

Figure 7:
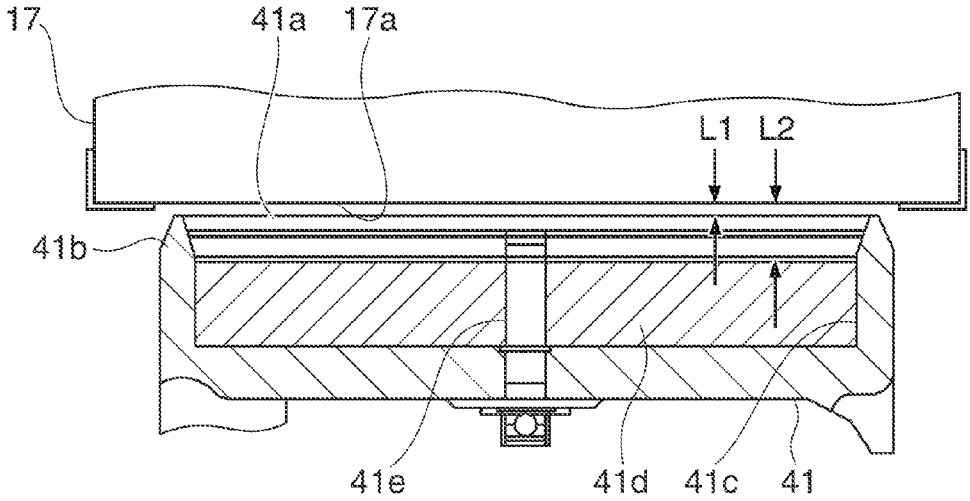
FIG. 7 is a section view of the head cleaning mechanism of the printer in FIG. 1 during a nozzle check.

As shown in FIG. 7, the head cap 41 is made of rubber or other elastic material and has a box-like configuration with the edge part 41*b* of the capping face 41*a* rising vertically. The size and shape of the head cap 41 enable the head cap 41 to contact the nozzle face 17*a* while the edge part 41*b* surrounds the part of the nozzle face 17*a* where the nozzles are formed. A vacuum tube extending from a pump motor (not shown) of the ink vacuum unit 43 is connected to the inside of the cavity 41*c* enclosed by the capping face 41*a* and edge part 41*b*. When the edge part 41*b* is touching the nozzle face 17*a* and the pump motor operates, the suction produced by the pump motor reduces the pressure in the sealed space formed by the cavity 41*c* and nozzle face 17*a*, and ink left in the nozzles of the inkjet head 17 is suctioned out and discharged into the cavity 41*c*.

The wiper 42 is a blade-like member made of rubber or other elastic material, and is supported slidably up and down by a guide member not shown fastened to the frame 44 of the head cleaning mechanism 40. Similarly to the head cap 41, the wiper 42 is configured so that it can move vertically to and away from the nozzle face 17*a* by operating a drive mechanism not shown. To wipe the nozzle face 17*a* with the wiper 42, the wiper 42 is raised until the distal end of the wiper 42 protrudes slightly above the level of the nozzle face 17*a* while the nozzle face 17*a* is offset horizontally from directly above the wiper 42, and the inkjet head 17 is then moved along the carriage guide shaft 21 so that the edge of the wiper 42 slides against the nozzle face 17*a*. Ink and foreign matter sticking to the nozzle face 17*a* is thus wiped off by the edge of the wiper 42.

When a print job ends and the inkjet head 17 is waiting in the standby position, the head cap 41 moves to a position where the edge part 41*b* contacts the surface around the nozzle face 17*a* and seals the nozzles. This inhibits ink in the nozzles from increasing in viscosity and nozzles becoming clogged while waiting to print. The wiping process whereby the wiper 42 wipes the nozzle face 17*a* can also be performed by raising the wiper 42 timed to the inkjet head 17 moving to the standby position side or the printing position side.

When nozzles become clogged and head cleaning is necessary, for example, an ink suction process can be performed to operate the pump motor while the head cap 41 is in the position sealing the nozzles to apply suction to the sealed space formed by the cavity 41*c* and nozzle face 17*a* and discharge ink from the ink nozzles.

In addition, a flushing process is also regularly performed to keep the ink droplets inside the ink nozzles in a desirable condition. This flushing process positions the inkjet head 17 to the head cap 41, and discharges a specific amount of ink from all nozzles of the inkjet head 17 into the cavity 41*c* in the head cap 41 in a non-printing operation. A nozzle recovery process that discharges a larger volume of ink droplets at one time than are discharged in the regular flushing process can also be performed as desired to clean the head and restore clogged nozzles.

The cleaning process could include any one of the wiping process, ink suction process, and flushing process, or a combination of these processes.

A nozzle check process (automatic clogged nozzle detection process) that inspects the ink ejection state of the ink nozzles may also be performed before these cleaning processes are performed, for example. Whether nozzle cleaning is necessary is determined based on the result of this nozzle check, and a nozzle cleaning process is performed as needed.

To perform this nozzle check, the head cleaning mechanism 40 also includes a nozzle check mechanism for detecting defective nozzles. More specifically, an absorbent member 41*d* for absorbing the discharged waste ink, and a conductor 41*e* that is electrically conductive with the absorbent member 41*d*, are disposed in the cavity 41*c*. An electrical signal flowing through the conductor 41*e* is extracted through a wire, for example. This configuration enables discharging charged ink droplets from each nozzle of the inkjet head 17, and extracting a signal denoting the change in current produced when charged ink droplets land on the absorbent member 41*d*. A nozzle is recognized as defective when the detection signal (the signal denoting the change) is less than or equal to a specific threshold value when the nozzle is driven to eject an ink droplet onto the absorbent member 41*d*. Other methods of detecting defective nozzles can also be used, including methods that use optical means such as a laser to detect ejected ink droplets.

The nozzle check process more specifically discharges charged ink droplets from the nozzles of the inkjet head 17, and inspects the discharge state of ink droplets from the tested nozzles based on a signal denoting the current change when ink droplets land on the absorbent member 41*d* in the cavity 41*c*. When the nozzle check process is performed, the head cap 41 is positioned so that the gap L1 between the nozzle face 17*a* and the edge part 41*b* of the head cap 41, and the gap L2 between the nozzle face 17*a* and the surface of the absorbent member 41*d*, are specific dimensions, and the inkjet head 17 side is grounded so there is a specific potential difference between the inkjet head 17 and head cap 41, and voltage is applied to the head cap 41 side to create a specific field state. The ink droplets discharged from the inkjet head 17 are charged by this field to carry a specific charge until landing. When the ink droplets land, the charge flows to the conductor 41*e*. As a result, the ink droplet discharge state can be inspected with good precision.

Figure 8:
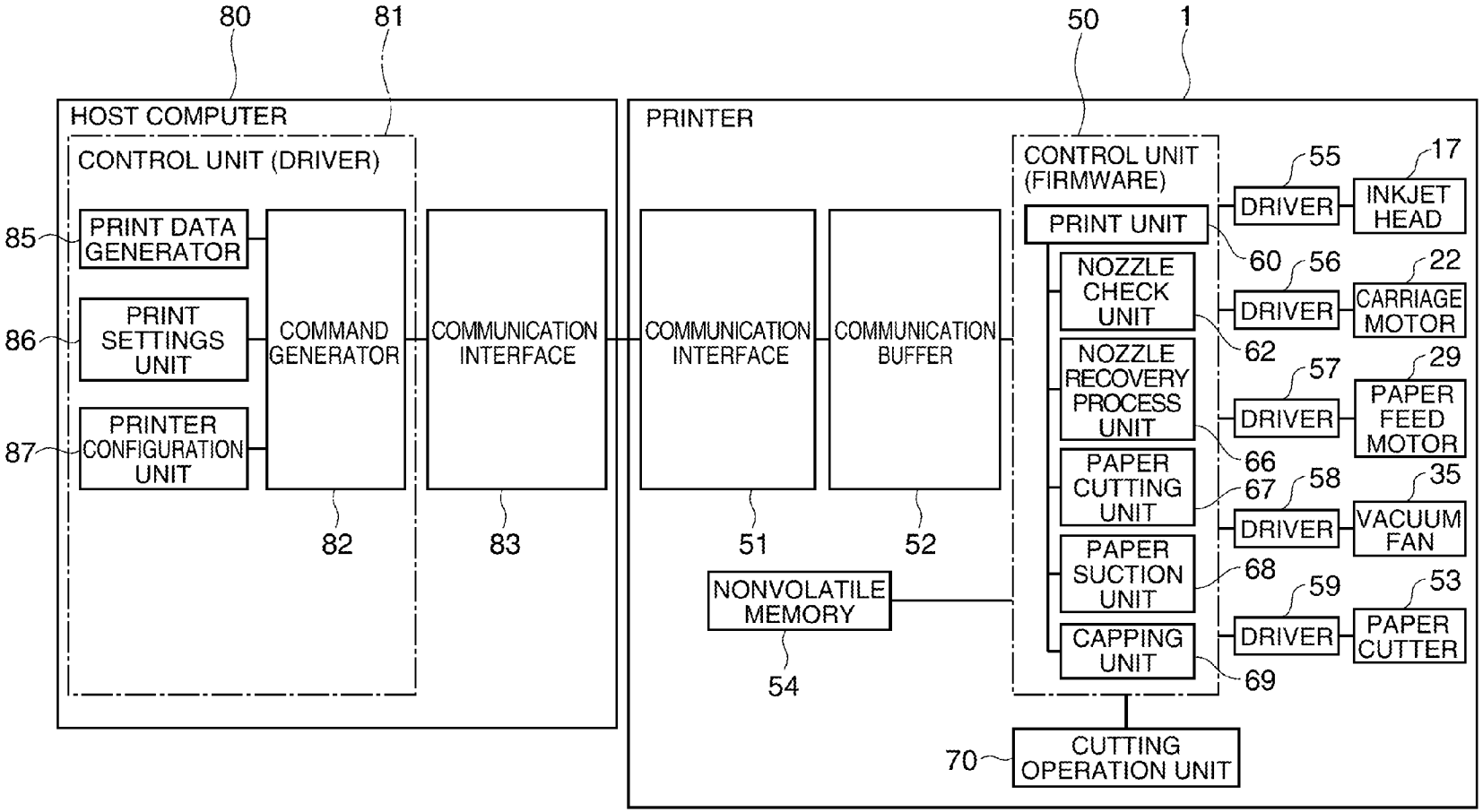
FIG. 8 is a block diagram of the control system of the printer in FIG. 1.
Figure 9A:
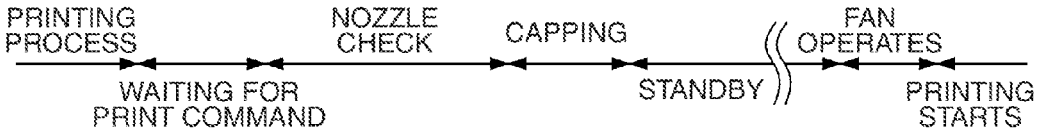
FIG. 9 is a timing chart of control after printing ends under different conditions.
Figure 9B:
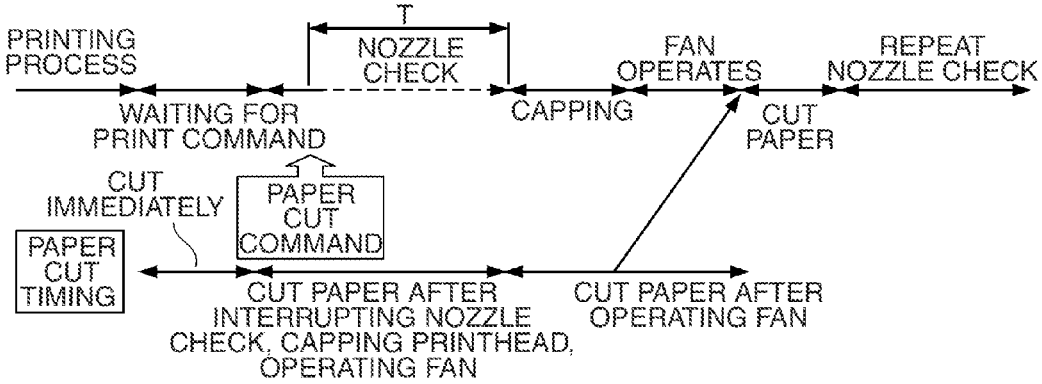
Figure 9C:
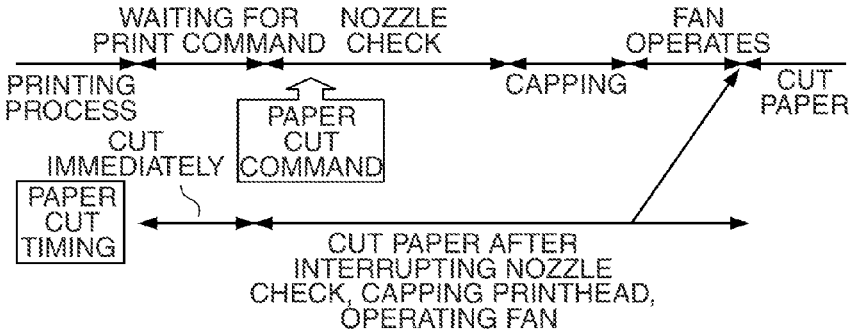
Figure 9D:
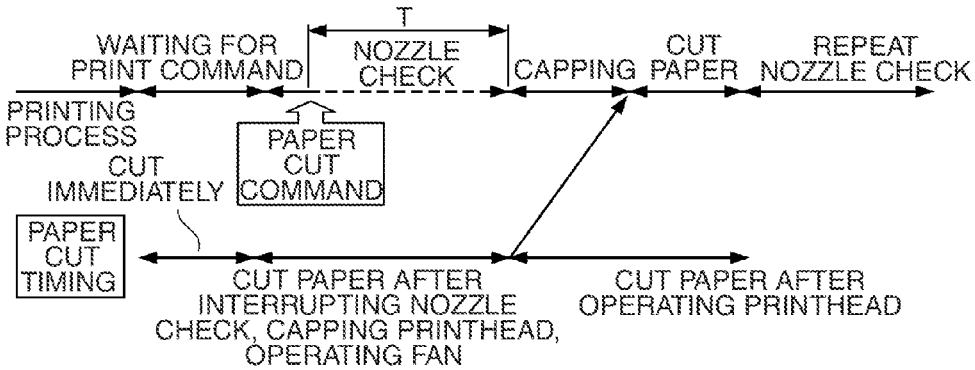

As shown in FIG. 8, the control system of the printer 1 is built around a control unit 50 that includes a CPU, ROM, and RAM. Print data from a host computer 80 is input to the control unit 50 through a communication interface 51 and communication buffer 52. Nonvolatile memory 54 such as flash ROM is connected to the control unit 50, and the nonvolatile memory 54 functions as a buffer storing converted print data and various settings.

The inkjet head 17, carriage motor 22, paper feed motor 29, vacuum fan 35, and paper cutter 53 are connected to the output side of the control unit 50 through respective drivers 55 to 59. The control unit 50 also has a print unit 60, nozzle check unit 62, nozzle recovery process unit 66, 67, paper suction unit 68, and capping unit 69.

The print unit 60 controls driving the carriage motor 22 and paper feed motor 29 to print on the recording paper 10 based on the print data.

The nozzle check unit 62 executes a nozzle check process that determines if ink droplets are ejected normally from each ink nozzle based on the change in current signals obtained from the conductor 41*e* of the nozzle check mechanism.

If ink droplets are not ejected normally from each ink nozzle, the nozzle recovery process unit 66 executes a nozzle recovery process to restore the ink droplet ejection state of each ink nozzle to normal. More specifically, the nozzle recovery process unit 66 controls driving the head cleaning mechanism 40 to perform the operation that suctions ink from the ink nozzles. The nozzle recovery process unit 66 may also control driving the carriage motor 22 and head cleaning mechanism 40 to wipe the inkjet head 17 nozzle face 17*a* with the wiper 42.

The paper cutting unit 67 drives the paper cutter 53 disposed to the paper exit 4 to cut the printed portion of the recording paper 10 discharged from the paper exit 4.

The paper suction unit 68 suctions air from the suction holes 34 and pulls the recording paper 10 conveyed over the vacuum platen 8 surface 8*a* to the surface 8*a* by operating the vacuum fan 35 of the recording paper suction mechanism.

When a print job ends and the inkjet head 17 is waiting at the standby position, the capping unit 69 controls driving the head cleaning mechanism 40 to move the head cap 41 to where the edge part 41*b* touches the area around the nozzle face 17*a* to seal the nozzles. This inhibits ink in the nozzles from increasing in viscosity and nozzles becoming clogged while waiting to print.

The host computer 80 is a host device connected to the printer 1, and the control unit 81 (printer driver) of the host computer 80 includes a CPU, ROM, and RAM. Print data is sent from the host computer 80 to the printer 1 through a command generator 82 and communication interface 83.

The control unit 81 includes a print data generator 85, print settings unit 86, and printer configuration unit 87. The print data generator 85 produces print data from input images and text. The print settings unit 86 sets the number of copies, print quality, and other settings.

The printer configuration unit 87 configures settings such as the operating state (such as continuous operation or not) of the vacuum fan 35 of the recording paper suction mechanism in the printer 1. This printer configuration unit 87 sets the printer 1 to a "pause fan" mode in which operation of the vacuum fan 35 is stopped after printing ends, or a "continuous fan" mode in which vacuum fan 35 operation continues after printing ends.

When the printer 1 receives a print command and print data from the host computer 80, the vacuum fan 35 of the recording paper suction mechanism is operated by the paper suction unit 68, air is pulled through the suction holes 34, and the recording paper 10 conveyed over the vacuum platen 8 surface 8*a* is pulled to the platen surface 8*a* Ink droplets are then ejected from the ink nozzles of the inkjet head 17 by the print unit 60 to print on the recording paper 10 thus held to the vacuum platen 8. The printed recording paper 10 is then discharged from the paper exit 4, and is cut with the paper cutter 53 by the paper cutting unit 67.

A cutting operation unit 70 including a pushbutton switch, for example, disposed to the printer housing 2 is also connected to the control unit 50. The control unit 50 also sends a paper cut command to the paper cutting unit 67 and cuts the recording paper 10 by means of the paper cutter 53 when the cutting operation unit 70 is pressed by the user. The user may press the cutting operation unit 70 to cut the recording paper 10 as desired.

As shown in FIG. 9 (*a*), the printer 1 waits for a print command after printing ends. This print command wait is a specific delay time during which the printer 1 waits to receive print data. If print data is received during this print command wait time, the printer 1 executes a printing process based on the received print data.

If print data is not received, the nozzle check process of the nozzle check unit 62 is performed for approximately 5 seconds after the print command wait period ends, the capping unit 69 then caps the nozzle face 17*a* of the inkjet head 17 that was moved to the standby position with the head cap 41 in about 1 second, and the printer 1 then enters the standby mode. If the printer 1 is set to the pause fan mode, the vacuum fan 35 stops after printing ends. Note that the print command wait time is set a time from 3 second to 15 seconds in which problems resulting from the ink nozzles of the inkjet head 17 drying will not occur.

When print data and a print command are sent from the host computer 80 to the printer 1 in the standby mode, the paper suction unit 68 first operates the vacuum fan 35, and the print unit 60 starts printing to the recording paper 10 after approximately 2 seconds, during which the recording paper 10 is held firmly to the vacuum platen 8 by the vacuum fan 35.

Operation of the printer 1 when the user presses the cutting operation unit 70 after printing ends is described next.

As shown in FIG. 9 (*b*), when the cutting operation unit 70 of the printer 1 is pressed by the user after printing ends, the paper cutting unit 67 operates the paper cutter 53 if the cutting operation unit 70 is pressed while the printer 1 is waiting for a print command. As a result, the recording paper 10 is cut immediately after the cutting operation unit 70 is pressed.

Figure 10:
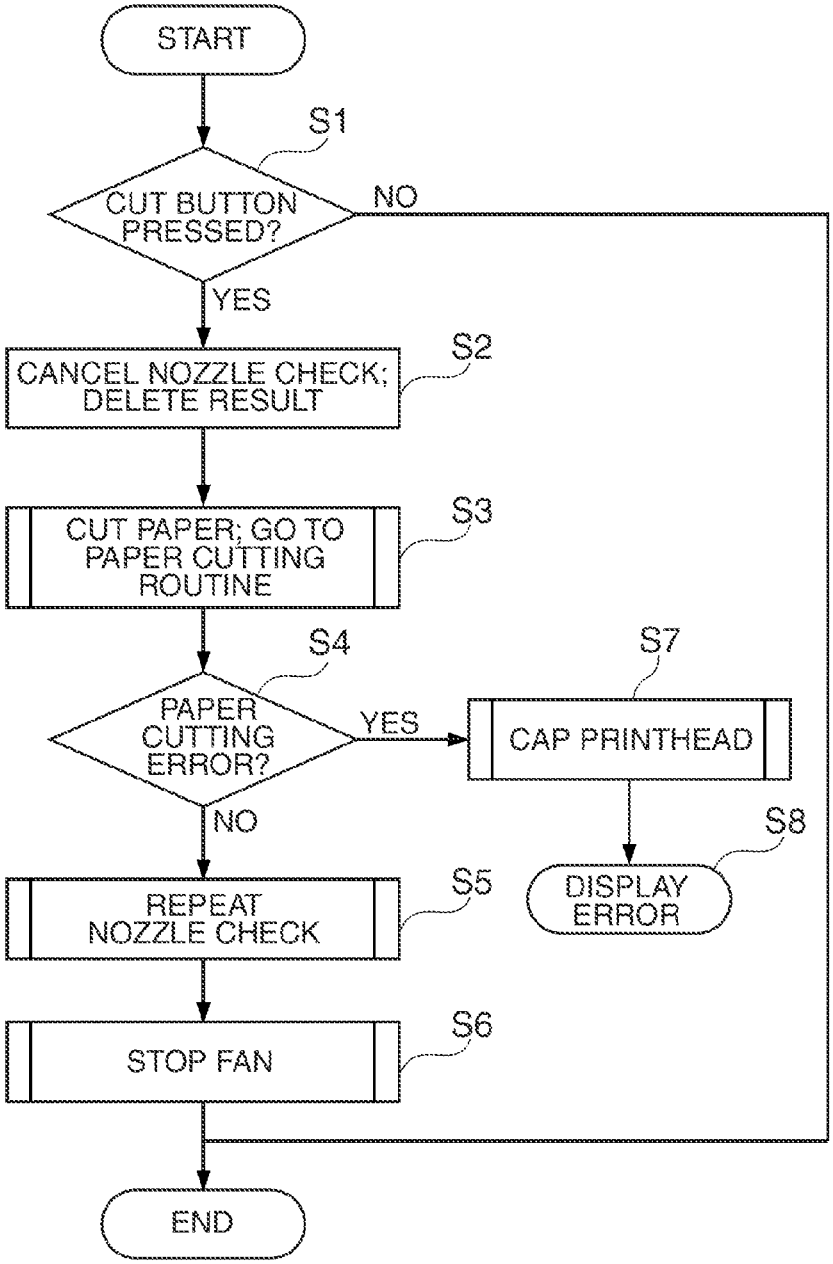
FIG. 10 is a flow chart of control when a paper cut command is asserted after printing ends.

If the print command wait period ended and the nozzle check process is executing, the control unit 50 controls operation as shown in the flow chart in FIG. 10.

First, the control unit 50 determines if the cutting operation unit 70 (cut button) was pressed (step S1), and if the cutting operation unit 70 was pressed (step S1 returns Yes), interrupts the nozzle check process and deletes the result of the nozzle check process (step S2).

The paper cutting unit 67 then executes the recording paper 10 cutting process (step S3). More specifically, after the nozzle check process is interrupted, the capping unit 69 caps the nozzle face 17*a* of the inkjet head 17 with the head cap 41. The paper suction unit 68 then operates the vacuum fan 35, the vacuum fan 35 pulls the recording paper 10 reliably to the vacuum platen 8 and holds the recording paper 10 stable, and the paper cutter 53 then cuts the recording paper 10. Note the flushing process is performed immediately after cutting the recording paper 10 as a followup operation.

Whether an error occurred when the recording paper 10 was cut by the paper cutter 53 is then determined (step S4), and if the recording paper 10 was cut without an error (step S4 returns No), the nozzle check process is started again by the nozzle check unit 62, the nozzles are checked sequentially from the first nozzle (step S5), the capping unit 69 caps the nozzle face 17*a* of the inkjet head 17 with the head cap 41, and the standby state is entered (step S6). Note that the decision of step S4 can be made using a paper detector that detects the presence of recording paper 10 discharged from the paper exit 4, for example.

If it is determined that an error occurred while cutting the recording paper 10 (step S4 returns Yes), the capping unit 69 caps the nozzle face 17*a* of the inkjet head 17 with the head cap 41 (step S7), and a cutting error is displayed on the display of the host computer 80 (step S8).

An example of control that does not interrupt the nozzle check process when the cutting operation unit 70 is pressed during a nozzle check process is described next.

As shown in FIG. 9 (*c*), when the cutting operation unit 70 is pressed during the nozzle check process, the nozzle check process continues and after the nozzle check process ends, the capping unit 69 caps the nozzle face 17*a* of the inkjet head 17 with the head cap 41. The paper suction unit 68 then operates the vacuum fan 35, and once the vacuum fan 35 pulls the recording paper 10 reliably to the vacuum platen 8 and holds the recording paper 10 stable, the paper cutting unit 67 operates the paper cutter 53 to cut the recording paper 10.

In this example of control that does not interrupt the nozzle check process, the recording paper 10 is cut after a maximum process time of 8 seconds, including the maximum of approximately 5 seconds required to perform the nozzle check process, the approximately 1 second until the nozzles are capped, and the approximately 2 seconds until the recording paper 10 is pulled to the vacuum platen 8, even if the cutting operation unit 70 is pressed during a nozzle check process that is performed after the print command wait period ends. In other words, user must wait a maximum of approximately 8 seconds after pressing the cutting operation unit 70.

With the control method of the invention shown in FIG. 9 (*b*), however, the time T of a maximum 5 seconds required to complete the nozzle check process is eliminated, and the recording paper 10 is cut immediately after the approximately 1 second until the nozzles are capped and the approximately 2 seconds until the recording paper 10 is pulled to the vacuum platen 8 (a total of 3 seconds) when the cutting operation unit 70 is pressed during a nozzle check process that is performed after the print command wait period ends. The user must therefore wait only approximately 3 seconds after pressing the cutting operation unit 70.

If a paper cut command is received while the nozzle check process is executing, the control method according to this embodiment of the invention thus interrupts the nozzle check process and performs the cutting process, and the delay until the cutting process executes can be substantially eliminated.

More specifically, even if the nozzle check process is executed when a print request is not received after printing ends, the nozzle check process can be interrupted and the requested cutting process can be preferentially executed to improve throughput. As a result, printing can be executed efficiently and job efficiency can be greatly improved. In addition, because the nozzle check process is performed if a paper cut command is not received during the nozzle check process, the cleaning process can be performed as necessary according to the result, and problems such as clogged nozzles can be eliminated. The printing process can therefore be executed with good print quality.

Because the nozzle check process is performed when a print command is not received during the print command wait period after printing stops, interrupting the nozzle check process and performing the cutting process does not interfere with execution of the printing process. Overall throughput of printer 1 processes can therefore be improved by preferentially performing the cutting process if a print request has not been received.

The inkjet head 17 is also capped before the cutting process to protect the inkjet head 17 and maintain the ink meniscus in the nozzles.

In addition, the nozzle check process can be performed again and the standby mode entered after the cutting process executes, enabling printing with good print quality at all times.

Note that the control described above is applied when the printer 1 is set to the pause fan mode by the printer configuration unit 87, but when the printer 1 is set to the continuous fan mode by the printer configuration unit 87, the vacuum fan 35 continues operating after printing ends so that the recording paper 10 is continuously held to the vacuum platen 8.

In the continuous fan mode, therefore, the capping unit 69 caps the nozzle face 17*a* of the inkjet head 17 with the head cap 41, and the paper cutter 53 operates to cut the recording paper 10, after the nozzle check process is interrupted when the cutting operation unit 70 is pressed after the print command wait period has ended as shown in FIG. 9 (*d*).

As a result, if the cutting operation unit 70 is pressed during the nozzle check process after the print command wait period has ended, the recording paper 10 is cut immediately after the approximately 1 second process time required to cap the nozzles, the delay resulting from restarting the vacuum fan 35 can be eliminated, and the recording paper 10 can be cut even more quickly.

The invention being thus described, it will be obvious that it may be varied in many ways. Such variations are not to be regarded as a departure from the spirit and scope of the invention, and all such modifications as would be obvious to one skilled in the art are intended to be included within the scope of the following claims.

What is claimed is:

1. A method of controlling a printer that cuts paper according to a paper cut command after printing print data received from a host computer on the paper, comprising a step of:

interrupting an automatic clogged nozzle detection process that automatically detects clogged nozzles in the printhead after printing ends, and then executing a cutting process that cuts the paper, if the paper cut command is received while executing the automatic clogged nozzle detection process.

2. The method of controlling a printer described in claim 1, wherein:

the automatic clogged nozzle detection process is performed when a print request from the host computer is not received after waiting a specific print request wait time after printing ends.

3. The method of controlling a printer described in claim 1, wherein:

the cutting process is performed after performing a printhead capping process after interrupting the automatic clogged nozzle detection process.

4. The method of controlling a printer described in claim 1, wherein:

the automatic clogged nozzle detection process is performed again after interrupting the automatic clogged nozzle detection process and performing the cutting process.

5. A printer that cuts paper according to a paper cut command after printing print data received from a host computer on the paper, comprising:

a nozzle check unit that applies an automatic clogged nozzle detection process to a printhead after printing ends;

a paper cutter unit that cuts the paper according to a paper cut command;

a cutting operation unit that commands the paper cutter unit to cut the paper when operated by a user; and a control unit that interrupts the automatic clogged nozzle detection process and executes the cutting process when a paper cut command is received while applying the automatic clogged nozzle detection process to the printhead nozzles after printing ends.

6. The printer described in claim 5, wherein:

the nozzle check unit performs the automatic clogged nozzle detection process when a print request from the host computer is not received after waiting a specific print request wait time after printing ends.

7. The printer described in claim 5, further comprising:

a capping unit that caps the nozzle surface of the printhead with a head cap;

wherein the control unit causes the capping unit to perform a capping process that covers the nozzle surface of the printhead with a head cap after causing the nozzle check unit to interrupt the automatic clogged nozzle detection process, and then causes the paper cutter unit to perform the cutting process.

8. The printer described in claim 5, wherein:

the control unit causes the nozzle check unit to interrupt the automatic clogged nozzle detection process, causes the paper cutter unit to perform the cutting process, and then causes the nozzle check unit to perform the automatic clogged nozzle detection process again.

* * * * *